US008141723B2

(12) United States Patent
Whalen et al.

(10) Patent No.: US 8,141,723 B2
(45) **Date of Patent: *Mar. 27, 2012**

(54) INVERTED CELL HONEYCOMB STRUCTURE SHELVING

(75) Inventors: John Whalen, Sheridan, IL (US); John J. Hagemann, Plano, IL (US); Robert J. Yunger, Oswego, IL (US); Peter H. Henning, Sugar Grove, IL (US); Thomas Hurt, Elgin, IL (US); Jake Myre, Beaver Dam, WI (US)

(73) Assignee: Plano Molding Company, Plano, IL (US)

( * ) Notice: Subject to any disclaimer, the term of this patent is extended or adjusted under 35 U.S.C. 154(b) by 527 days.

This patent is subject to a terminal disclaimer.

(21) Appl. No.: 11/894,118

(22) Filed: Aug. 20, 2007

(65) Prior Publication Data

US 2008/0053940 A1 Mar. 6, 2008

Related U.S. Application Data

(60) Provisional application No. 60/822,878, filed on Aug. 18, 2006.

(51) Int. Cl.
*A47F 5/00* (2006.01)

(52) U.S. Cl. ..... 211/135

(58) Field of Classification Search ..... 211/135, 211/183, 188, 134, 74, 41.3, 126.1, 126.2, 211/133.6, 194, 189; 108/51.3, 57.18, 57.28, 108/57.29, 57.34

See application file for complete search history.

(56) References Cited

U.S. PATENT DOCUMENTS

| | | | | | |
|---|---|---|---|---|---|
| 3,695,188 | A | * | 10/1972 | Granatstein | 108/57.28 |
| 3,814,031 | A | * | 6/1974 | Fowler | 108/57.28 |
| 3,938,448 | A | * | 2/1976 | Nishitani et al. | 108/57.26 |
| 4,344,266 | A | * | 8/1982 | Gray | 52/741.11 |
| 4,475,624 | A | * | 10/1984 | Bourland et al. | 181/292 |
| 4,539,455 | A | | 9/1985 | Colato et al. | |
| 4,790,966 | A | * | 12/1988 | Sandberg et al. | 264/39 |
| 4,793,267 | A | | 12/1988 | Birillo | |

(Continued)

OTHER PUBLICATIONS

Chen, An and Davalos, Julio F., Behavior of Honeycomb FRP Sandwich Sinusoidal Core Panels with Skin Effect, Engineering, Construction, and Operations in Challenging Environments: Earth & Space 2004, abstract of pp. 625-632.

(Continued)

*Primary Examiner* — Jennifer E. Novosad
(74) *Attorney, Agent, or Firm* — McGuireWoods LLP

(57) ABSTRACT

A shelf panel for support of items made of an array of honeycomb-shaped cells, alternatively closed at opposite ends to create an array. The thickness of the honeycomb cells may be varied along an arch distribution with the shape of contemplated deformations. The array of honeycomb cells may be surrounded by a ring of alternatively configured cells to create regularly shaped shelf panels. The surrounding cells of a second thickness allow for possible stacking between two shelf panels including a cylindrical corner cell with a top cylinder able to accommodate a bottom cylinder from a second shelf panel. The surrounding cells may also include a wedge of the same geometry as the selected cell where part of the wedge is inserted in the cell and the other part of the wedge is a mechanical fixation means. Some circumferential cells may be adapted to be either a male or female interlocks allowing for two or more shelf panels to be interlocked if they are disposed adjacent each other on a same plane.

25 Claims, 9 Drawing Sheets

U.S. PATENT DOCUMENTS

| | | | | |
|---|---|---|---|---|
| 4,859,517 | A * | 8/1989 | Hull | 428/116 |
| 5,041,323 | A * | 8/1991 | Rose et al. | 428/116 |
| 5,137,160 | A | 8/1992 | Santucci | |
| 5,205,221 | A * | 4/1993 | Melin et al. | 108/51.3 |
| 5,445,861 | A * | 8/1995 | Newton et al. | 428/116 |
| 5,683,004 | A | 11/1997 | Aho | |
| 5,752,608 | A * | 5/1998 | Dingeldein | 211/23 |
| 5,912,442 | A * | 6/1999 | Nye et al. | 181/292 |
| 6,019,225 | A * | 2/2000 | Kalmakis et al. | 206/563 |
| 6,039,563 | A * | 3/2000 | Hardy | 431/291 |
| D424,331 | S * | 5/2000 | Juang | D6/470 |
| 6,079,339 | A | 6/2000 | Houk, Jr. et al. | |
| 6,178,896 | B1 | 1/2001 | Houk, Jr. et al. | |
| 6,319,586 | B1 | 11/2001 | Colson | |
| 6,435,355 | B1 * | 8/2002 | Brown | 211/44 |
| 6,609,592 | B2 * | 8/2003 | Wilson | 181/292 |
| D484,333 | S | 12/2003 | Frederick | |
| 6,837,171 | B1 | 1/2005 | Clark et al. | |
| 6,877,826 | B2 * | 4/2005 | Wood et al. | 312/205 |
| 6,890,023 | B2 | 5/2005 | Preisler et al. | |
| 6,997,113 | B1 * | 2/2006 | Harding et al. | 108/53.1 |
| 7,055,704 | B2 * | 6/2006 | Alter | 211/153 |
| 7,540,354 | B2 * | 6/2009 | Morin et al. | 181/292 |
| 2002/0170839 | A1 * | 11/2002 | Chang | 206/315.6 |
| 2003/0214798 | A1 * | 11/2003 | Shirakami et al. | 361/796 |
| 2005/0224435 | A1 * | 10/2005 | Alter | 211/153 |
| 2007/0266910 | A1 * | 11/2007 | Lux et al. | 108/57.28 |
| 2008/0053940 | A1 * | 3/2008 | Whalen et al. | 211/134 |
| 2008/0145602 | A1 * | 6/2008 | Hendren et al. | 428/116 |
| 2008/0237319 | A1 * | 10/2008 | Hensey et al. | 229/103 |

OTHER PUBLICATIONS

Teplitskiy, Dr. Abram, Bee and Honeycomb, Student's Corner # 5, TRIZ Journal.

Prall, D. and Lakes, Roderic, Properties of a Chiral Honeycomb with a Poisson's Ratio-1, Int. J. of Mechanical Sciences, 1996, pp. 305-314, http://silver.neep.wisc.edu/~lakes/PoissonChiral.html.

Weisstein, Eric W., Honeycomb, from MathWorld, a Wolfram Web Resource, http://mathworld.wolfram.com/Honeycomb.html.

Lakes, Roderic, Advances in Negative Poisson's Ratio Materials, Advanced Materials, 1993, pp. 293-296, http://silver.neep.wisc.edu/~lakes/PoissonAdv.html.

Anderson, Todd A., Lightweight Composite Structures, ME 599 VK—Special Topics in Cellular Solids, Aeronautics & Astronautics, University of Washington, 2003.

* cited by examiner

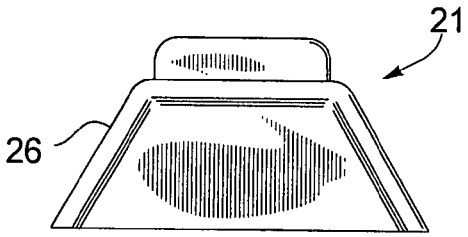
FIG. 10
FIG. 11
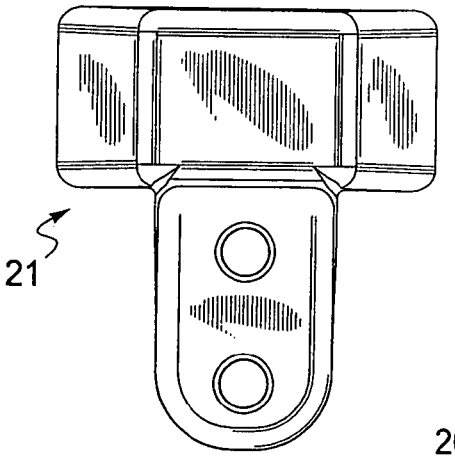
FIG. 12
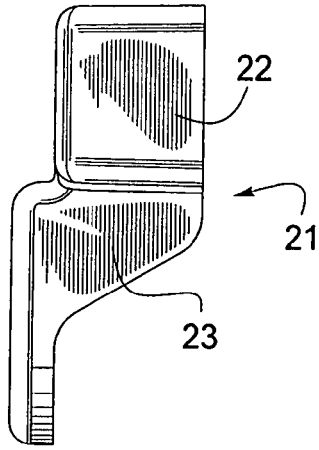
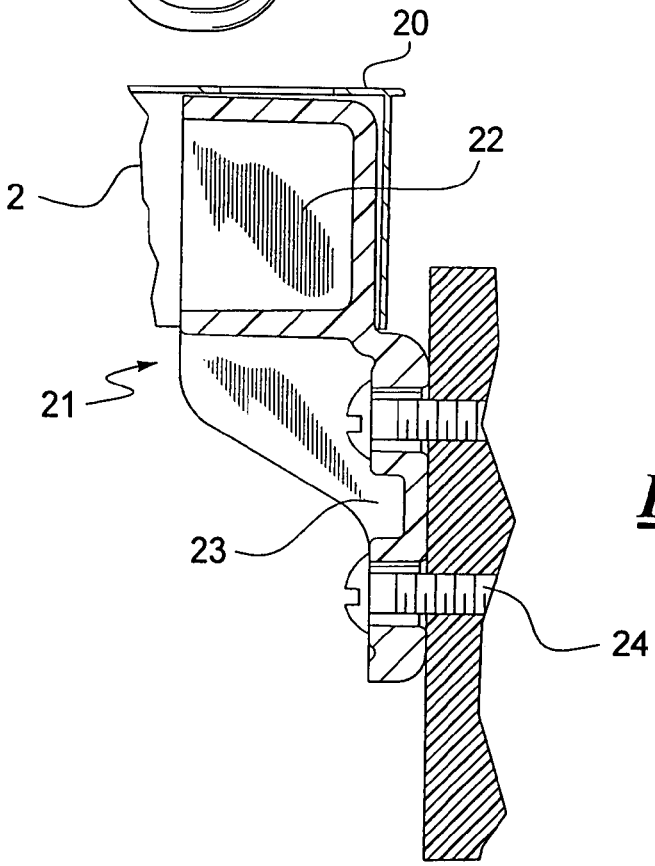
FIG. 13

INVERTED CELL HONEYCOMB STRUCTURE SHELVING

CROSS-REFERENCE TO RELATED APPLICATION

The present patent application claims priority from and the benefit of U.S. Provisional Patent Application No. 60/822,878, filed Aug. 18, 2006, and entitled INVERTED CELL HONEYCOMB STRUCTURE SHELVING, which prior application is hereby incorporated herein by reference.

FIELD OF THE INVENTION

The present invention relates to a shelving panel and assembly, and more particularly, to a molded shelf panel and shelving assembly having increased load bearing capacity and interconnectivity improvements.

BACKGROUND

Shelving is used to support items in homes, workplaces, and other locations where items must be stored and/or displayed. Shelves may be made of plastic, metal, wood, glass, or any other material with sufficient mechanical strength to support loads. Shelves may also be given strength via use of composite materials, sandwiched materials, ribbed structures, or hollowed-out materials of all sorts.

Shelves may abut vertical surfaces such as walls and be fixed using a fixation means. A nonlimiting example would be a flat, wooden shelf fixed on a wall with screws. Shelves may also be part of shelving systems where one or a plurality of shelves are assembled to create a shelving assembly. Shelving systems may also include other auxiliary features designed to supplement the usefulness of the product, improve aesthetics, and provide other useful characteristics.

Shelf and shelving unit design is a constant balance among useful characteristics based on design elements, such as strong mechanical resistance, limited encumbrance, low weight, and low manufacturing and transportation costs. Shelves must resist excessive bending or deformation from permanent or temporary loads. Panels made of sandwich-type composite structures with a cellular-core, light fibrous material display favorable weight to strength characteristics, but such panels commonly used, for example in the aircraft construction industry, are expensive and must be manufactured in several steps as described in U.S. Pat. No. 6,890,023 to Preisler et al.

Auxiliary features, such as interlocks, support wedges, and ground supports, are secured to the shelf or the shelving unit using any of a plurality of known mechanical means. What is needed is a shelf panel cell structure where auxiliary features are an integral part of the design and are of a geometry able to functionally merge into the shelf or shelving unit.

A first object of the present invention is to provide a shelving panel construction exhibiting the favorable weight to strength advantages of a sandwich-type airplane material without the disadvantages of the prohibitive costs associated with a composite structure core in high technology fields. A second object of the present invention is to create a shelf with a unique cell arrangement where maximal load resistance is obtained with minimal overall weight of the panel. A third object of the invention is to provide a shelving panel cell arrangement where the thickness of the shelf can be varied to minimize deformation under a load according to anticipated deformations. A fourth object of the invention is to define a modular structure designed to promote stacking features and ground-holding elements. A fifth object of the invention is to define a modular arrangement able to hold male and female interlocks for linking shelves together. A sixth object of the invention is to provide a shelving assembly where the modular structures are of such a type to house a strong shelf support wedge. Finally, a seventh object of this invention is to provide a modular structure able to serve alternatively as a post support, a stacking support, or a ground support.

SUMMARY OF THE INVENTION

In carrying out the above objectives of the present invention, a shelf panel for support of items is made of an array of honeycomb-shaped cells, which are closed at opposite ends to create an array of inverted honeycomb cells that may be surrounded by a row of cells made of a second type. In one preferred embodiment, the panel is made of injection-molded plastic of a single piece. The use of honeycomb-shaped cells in a rigid, rib-like injection-molded volume corresponds to the use of the sandwich-type layer in airplane material without the surface layers. By using this unique arrangement of cells, with known symmetric resistance in the plane of the shelf panel, the load resistance may be obtained at a minimum overall weight of the panel. In the case of a linear load on a flat panel, the deformation of the shelf panel will form an arch centered in the middle of the shelf panel. Accordingly, in another preferred embodiment, the thickness of the honeycomb cells in the array is varied along an arch distribution with the shape of contemplated deformations. In a further embodiment, the array of honeycomb cells is surrounded by a ring of cells to create regular-shaped shelf panels. These surrounding cells of a second thickness allow for possible stacking of two shelf panels having a cylindrical corner cell where a top cylinder is able to accommodate a bottom cylinder from a second shelf panel. In yet another embodiment, the surrounding cells include a wedge of the same geometry as the selected cell where part of the wedge is inserted in the cell and the other part of the wedge is a mechanical fixation means. Finally, according to another embodiment, some circumferential cells are adapted to be either a male or female interlock allowing for two or more shelf panels to be interlocked when they are disposed adjacent to each other on a same plane.

BRIEF DESCRIPTION OF THE DRAWINGS

FIG. 10 is a top view of a fixation wedge in accordance with a possible embodiment.

FIG. 11 is a front view of the fixation wedge of FIG. 10.

FIG. 12 is a side view of the fixation wedge of FIG. 10.

FIG. 13 is a middle sectional view of the fixation wedge shown on FIG. 11 in a mounted configuration on a wall and in a shelf panel shown on FIG. 1.

DETAILED DESCRIPTION

Figure 1:
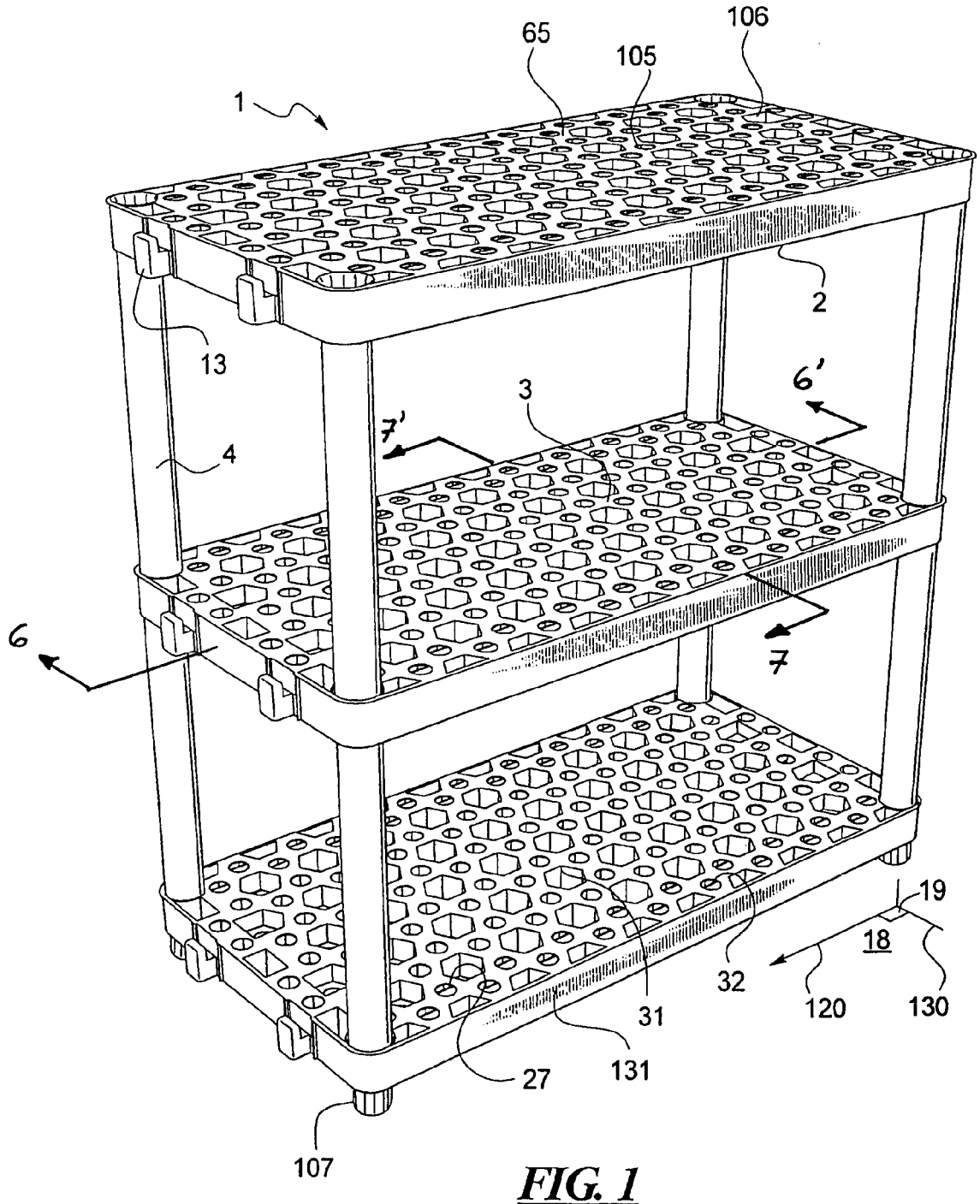
FIG. 1 is a perspective view of a shelving assembly made of three horizontal shelf panels vertically arranged and joined by cylindrical posts in accordance with a possible embodiment.

FIG. 1 is a perspective view of a shelving assembly 1 made of three horizontal shelf panels 2 vertically arranged and united successively by cylindrical posts 4 in accordance with a possible embodiment. In a preferred embodiment, the shelf panels 2 are stacked equidistant by placing one cylindrical post 4 at each corner of the shelf panels 2. It is understood by one of ordinary skill in the art that while equidistant shelf panels 2 are shown in the shelving assembly 1 where one shelf panel 2 is held at a distance from one other shelf panel 2 with four cylindrical posts 4 of a determined length, and another shelf panel 2 serves to unite structurally all cylindrical posts 4. What is contemplated is a shelving assembly 1 where the cylindrical posts 4 and the shelf panels 2 are used in spatial relationship as spacing elements and shelving elements to be used and arranged indiscriminately to create shelving assemblies of different configurations. What is also contemplated is the use of shelf panels 2 of different sizes and thicknesses and the use of cylindrical posts 4 of different radii, geometries, and heights. It is also understood by one of ordinary skill in the art that, while in the preferred embodiment depicted in FIG. 1 support cylindrical posts 4 are shown on each corner of the shelf panels 2, sufficient support may be obtained from a lesser support, such as, in a nonlimiting example, the use of three cylindrical ports 4 on three corners of the shelf panels 2 or the use of cylindrical supports 4 at other location on the shelf panel 2. As a nonlimiting example, based on the characteristics of a shelving assembly 1 to be used, the use of a single cylindrical post 2 or any combination thereof is also contemplated.

Figure 2:
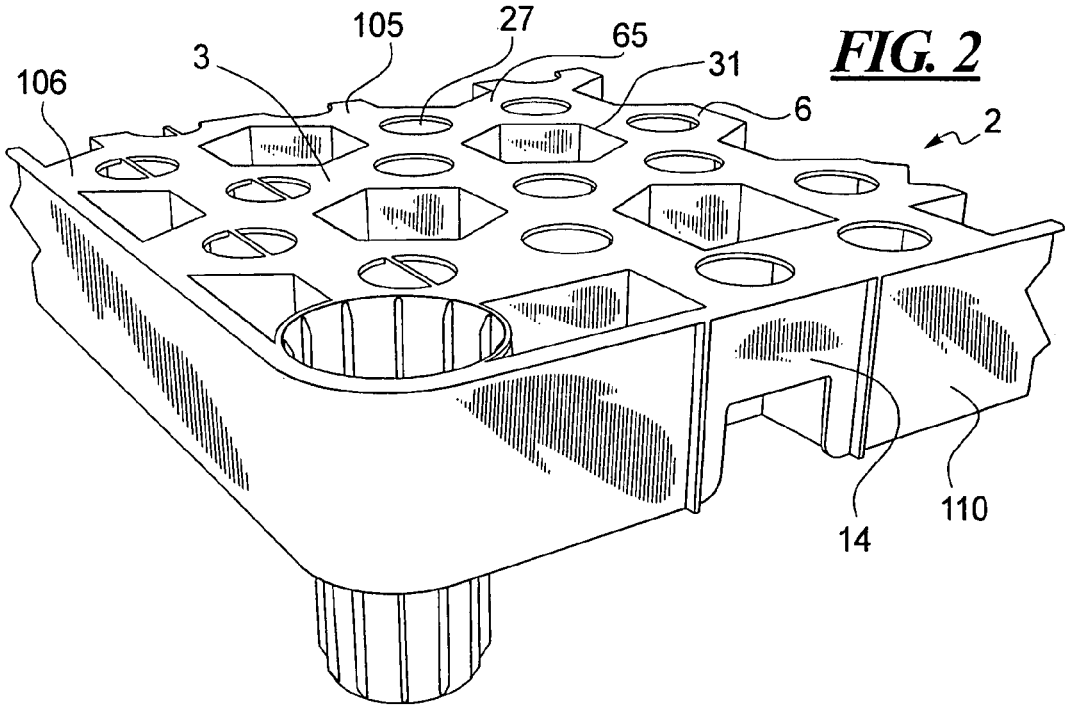
FIG. 2 is a perspective corner view of a shelf panel depicting the lower portion of the corner according to a possible embodiment.
Figure 3:
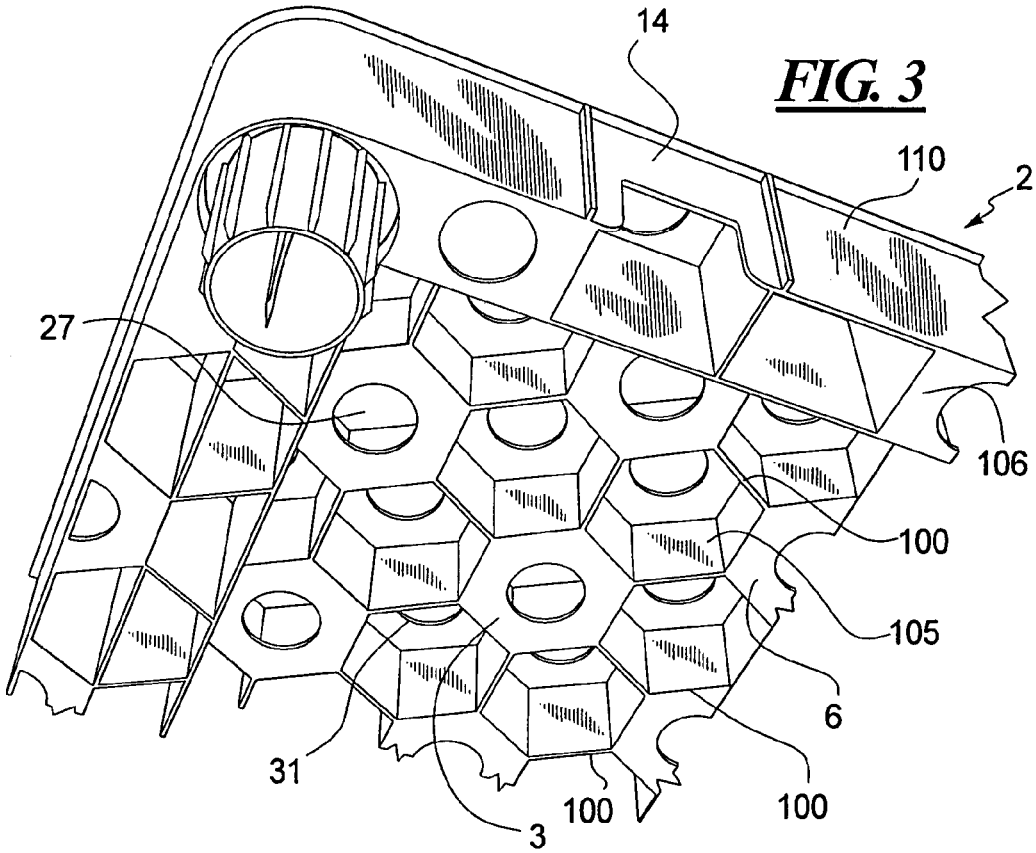
FIG. 3 is a perspective corner view of the shelf panel depicting the upper portion of the corner of FIG. 2.

A shelf panel 2 is shown on a plane 19 illustrated by a reference number 18 illustrated next to the shelving assembly 1 on FIG. 1. It is understood by one of ordinary skill in the art that while the plane 19 is illustrated as a horizontal plan, the plane 19 may be in any orientation. FIGS. 2-3 show upper and lower perspective corner detail views of the shelf panel 2 shown without the cylindrical post 4. The shelf panel 2 is made of an array of inverted honeycomb cells 3, each made of a lateral honeycomb-shaped wall 31 shown on FIG. 1 with an upper end 62 and a lower end 63 as shown on FIGS. 6-7, and a cell closing wall 6. The cell closing wall 6 is alternately connected to the upper end 62 and the lower end 63 of alternating cells along the plane 19 to form an array of inverted honeycomb cells 3. What is defined as an array of inverted honeycomb cells 3 is a three-dimensional structure made of honeycomb shapes defining a core of a sandwich-type structure along a plane 19 where closing walls 6 are placed alternatively on the upper end 62 and the lower end 63 of cells instead of placing a complete layer of material on each end of the honeycomb cells joining every cell. The inverted array of honeycomb cells 3 as shown in FIG. 1 is made of a regular and repeating pattern where closing walls are placed on the upper end 62 of cells to form an adjoining surface. In one preferred embodiment, to improve the support surface on a top section 65 of the shelf panel 2, a larger fraction of closing walls 6 is adjoined to the upper end 62. Among the numerous advantages and distinctive features of this structure is the fact that less material may be used to create effectively a reinforced sandwich-type structure while maintaining the mechanical resistance and planar surface holding capacities of both ends of inverted honeycomb cells 3. The term "inverted" refers to use of a plurality of honeycomb cells with a closing wall 6 placed at one extremity stacked alternatively by inverting a cell and surrounding it with a plurality of uninverted cells. It is understood by one of ordinary skill in the art while a preferred embodiment where each inverted cell with a closing wall 6 placed on the bottom end 63 of a cell is surrounded by cells where the closing wall 6 is connected to the upper end 62, what is contemplated is any arrangement where honeycomb cells are alternatively inverted.

Figure 14:
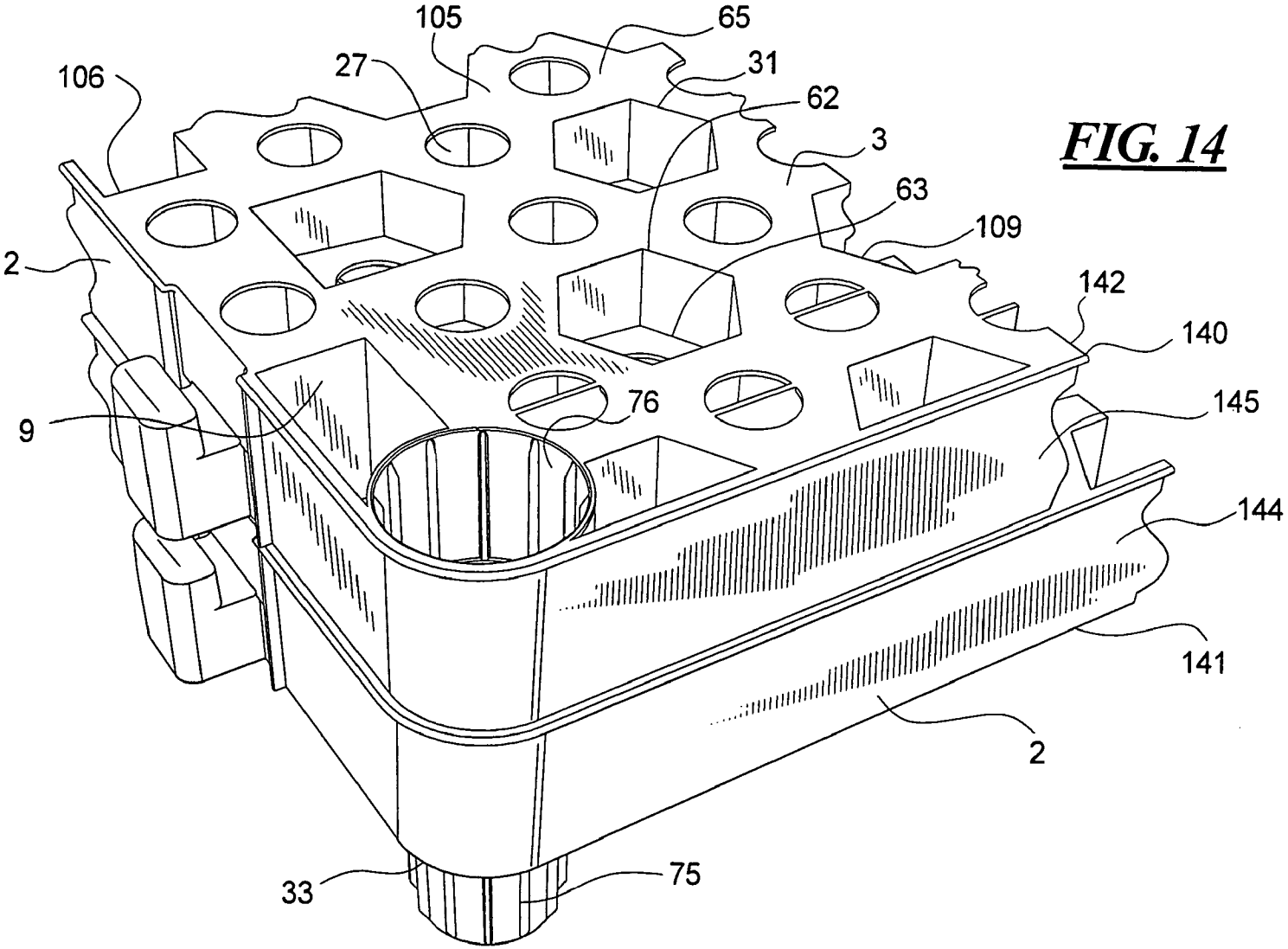
FIG. 14 is an illustration of two shelf panels as shown on FIG. 2 in a stacked configuration.
Figure 15:
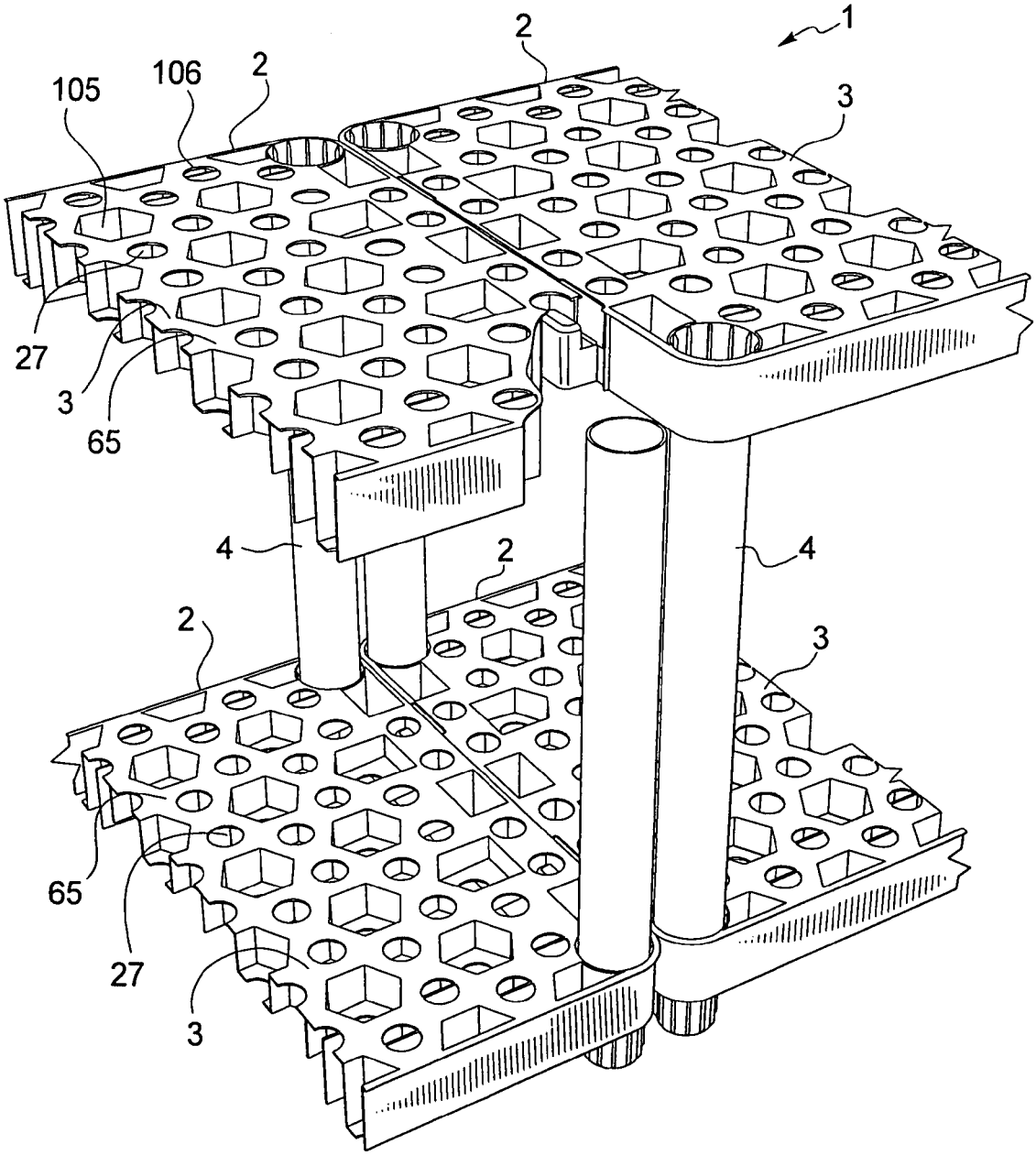
FIG. 15 is a partial cut view of two of the three vertical panels of the shelving assembly of FIG. 1 to better illustrate the interface between two shelf panels on a plane.
Figure 16:
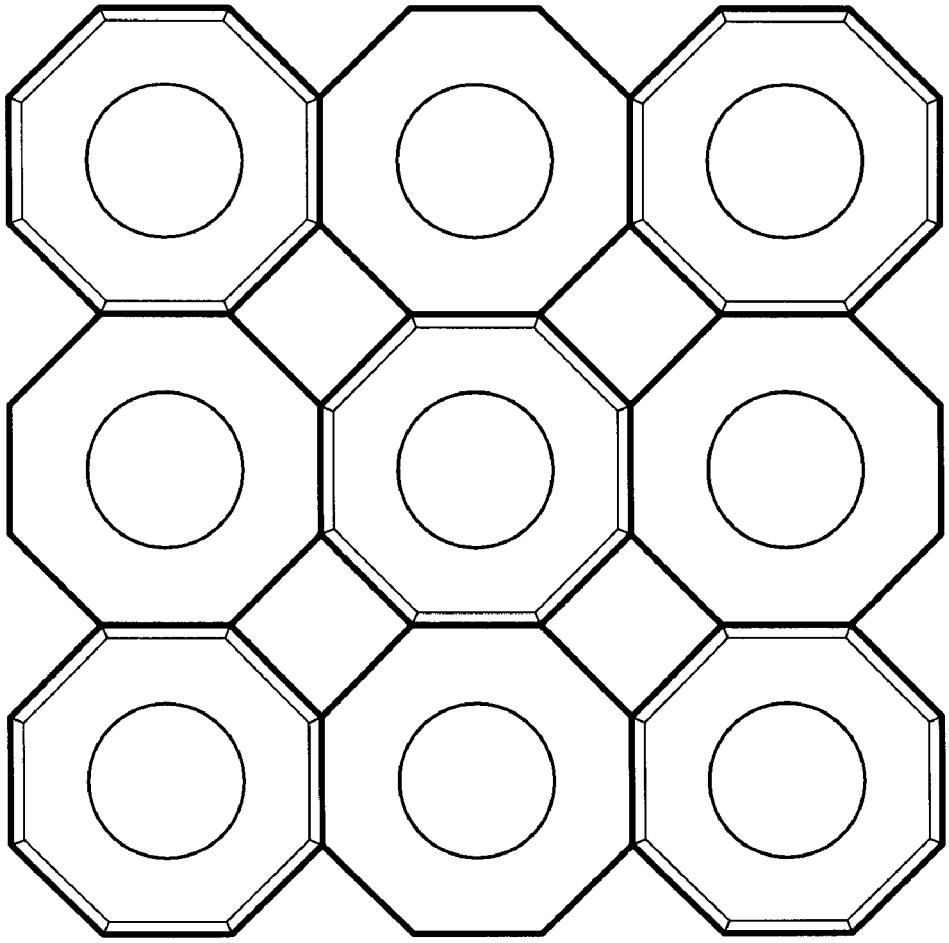
FIG. 16 shows a partial bottom view of a shelf panel having a plurality of lateral honeycomb shaped walls having an octagonal prism shape in accordance with a possible embodiment.

In preferred embodiments shown in FIGS. 1-5 and 14-15, the lateral honeycomb-shaped wall 31 may have a hexagonal prism shape. What is also contemplated is a lateral honeycomb shape where the wall 31 may have an octagonal prism shape as shown in FIG. 16 or has any other number of lateral walls. What is contemplated is an array of cells that possess tessellate properties. What is also contemplated is the use of alternating cells that tessellate but do not possess similar geometries.

The use of an array of inverted honeycomb cells 3 creates a series of ribs 100 as part of the honeycomb shaped wall 31 that acts as a series of reinforcing ribs 100 as shown on FIG. 1. These ribs 100 are substantially perpendicular in orientation to the plane 19. The orientation of the walls 31 creates a planar distribution of the strain created by placing a weight on the planar shelf 2. It is recognized by one of ordinary skill in the art that strain distribution within a multilayer structure of a composite structure possesses advantaged. FIG. 1 shows a shelf panel 2 where adjoining cells, either inverted or not, share adjoining walls 31. In a preferred embodiment, the interlocked matrix of ribs 100 formed is of a single thickness. What is also contemplated is any combination of honeycomb-shaped walls 31, either shared or not, of varied height, shape, or thickness. In another embodiment, the structure of the ribs 100 created has a uniform wall thickness of 1/16".

The cell closing wall 6 is shown with a circular central passage with an edge defining a circular central passage 27 located on the center of each closing wall 6. What is contemplated is the use of a circular central passage 27 in the closing wall 6 when it is on the lower end 63, or when it is on the upper end 62 of the honeycomb shaped wall 31. The circular central passage 27 may, for example, serve to lighten the shelf panel 2, to help grasp the shelf panel 2, to allow the passage of fluids or debris, or even to serve to hold objects placed on the shelf panel 2. It is understood by one of ordinary skill that what is contemplated is a removal of material from the shelf panel 2 made according to molding and construction methods. As a nonlimiting example, other types of middle apertures are contemplated within the ribbed structure. In one preferred embodiment the shelf panel 2 is made of molded, extruded plastic, but what is contemplated is any method or the use of any material, such as wood, glass, metal, or the like.

Figure 4:
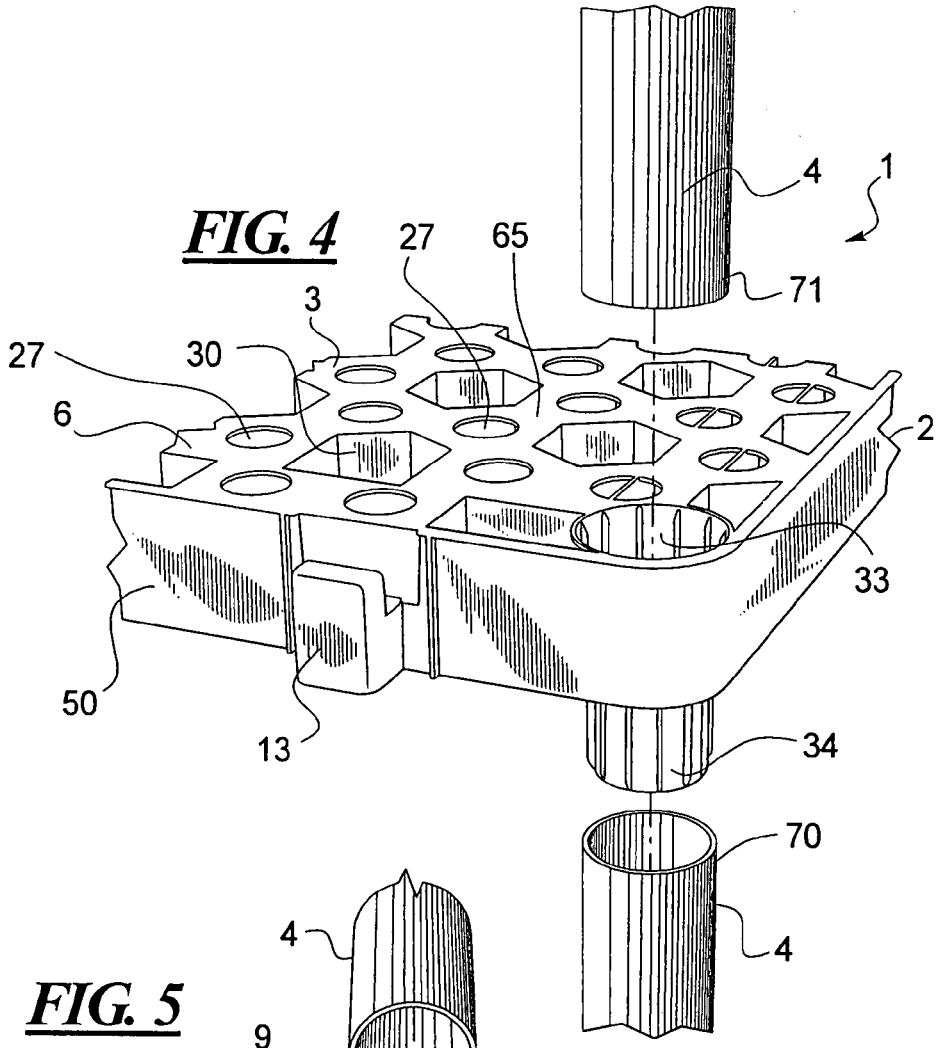
FIG. 4 is a perspective exploded corner view of detail from the middle shelf panel of FIG. 1 with two cylindrical posts depicting the upper portion of the corner.
Figure 6:
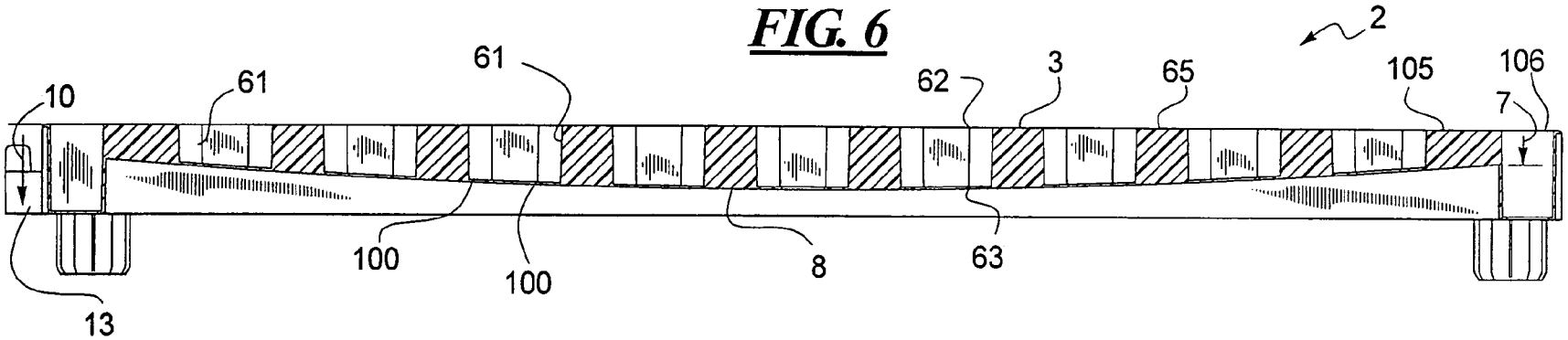
FIG. 6 is a sectional view taken, as indicated, along the line 6-6' on FIG. 1.
Figure 7:
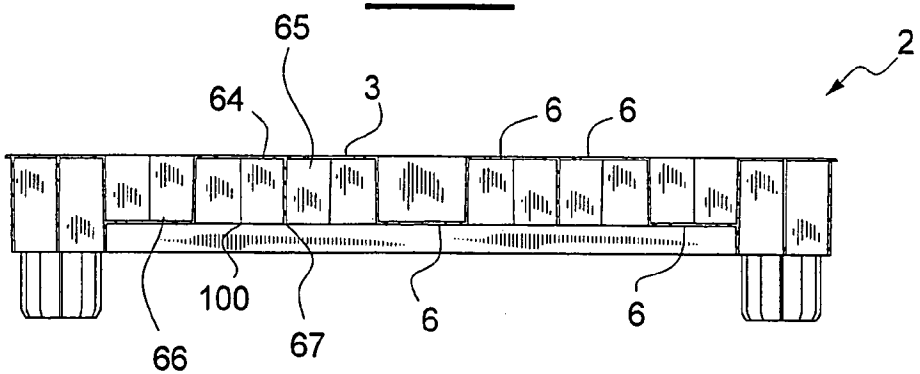
FIG. 7 is a section view taken, as indicated, along the line 7-7' on FIG. 1.

The shelf panels 2 are subject to strain when loads placed upon them. One of ordinary skill in the art recognizes that, based on the distribution of loads and in association with the position of the supports of the shelf panel 2, such as the use of circular posts 4 on each corner or a post support 34 as shown in FIG. 4, strain distribution deforms the shelf panel 2. As a nonlimiting example, a flat panel supported at its extremities and loaded uniformly along its length deforms along a convex arch with a maximum deformation located between both extremities. To minimize deformation, the shelf panel 2 may be reinforced locally or according to the load distribution. What is contemplate and shown in FIG. 6 is the use of a lateral honeycomb cell wall 31 of variable height to create a variable depth of the shelf panel 2 in the distance perpendicular to the plane 19. The use of variable depth honeycomb cell wall 31 allows reduction of the ensuing deformation of the shelf panel 2 without having to increase the overall thickness and associated weight of the shelf panel 2. FIGS. 6-7 show one preferred embodiment where a longitudinal reinforcement is used to minimize the displacement along the direction where the distance between supports is maximum. What is contemplated is the use of structural reinforcements in any direction by use of a plurality of technologies including but not limited to a variation of the thickness of the ribs 100, the use of materials of greater resistance to deformation, the use of cells of smaller radius or geometry, the use of additional localized ribs, or the use of additional layers of reinforcement. It is understood by one of ordinary skill that contemplated reinforcements must be designed based on the associated design of the shelving assembly 1. For example, in a three shelf assembly where the first shelf panel 2 is wider than the second shelf panel 2, two different types and orientation of reinforcements is contemplated (not shown).

Figure 5:
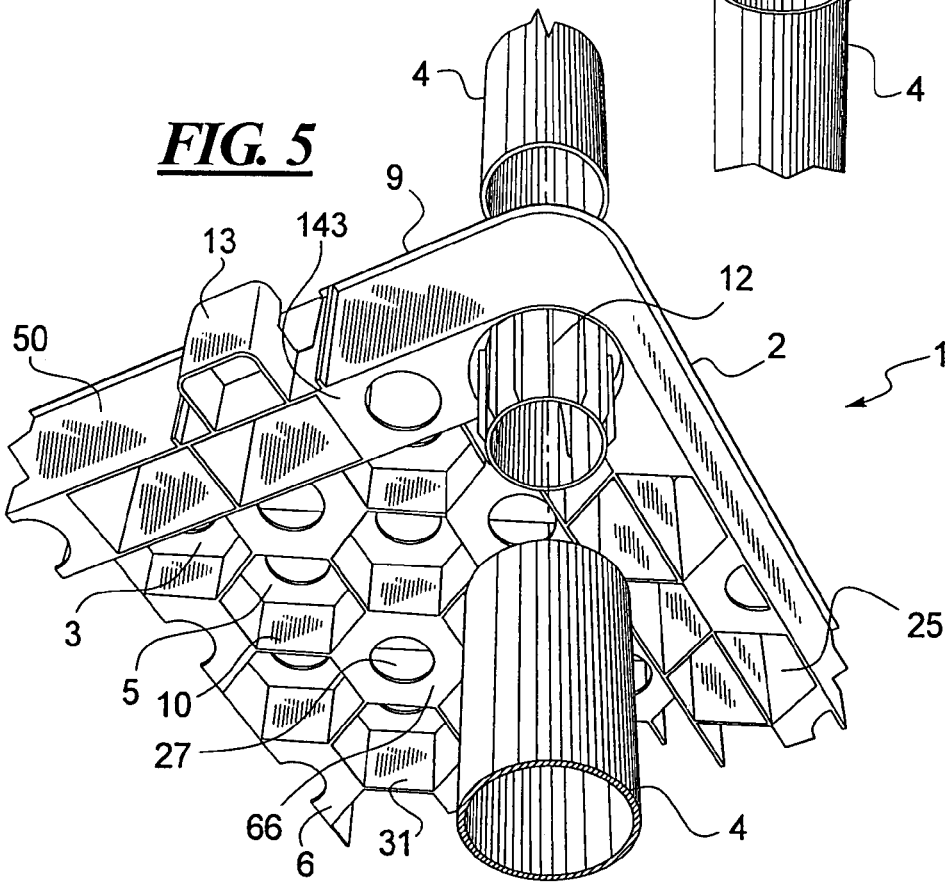
FIG. 5 is an perspective exploded corner view of detail from the middle shelf panel of FIG. 1 with two cylindrical posts depicting the lower portion of the corner.

In another embodiment, the shelf panel 2 is located on a plane 19 where the shelf panel 2 comprises a center region 105 made of an array of a first type of cells 109, shown in FIGS. 4-5 as an inverted honeycomb of cells 3, and a circumferential edge 106 of at least a second type of cells 9 secured to the center region 105 where the first type of cells 109 is of a first depth perpendicular to the plane 10 and the circumferential edge 106 is of a second depth perpendicular to the plane 19. What is shown in FIGS. 4-5 is an embodiment where the circumferential edge 106 is made of semihexagonal cells 9, rectangular cells 11, circular cells 33, and a pentagonal shape 30. It is understood by one of ordinary skill in the art that the circumferential edge 106 may serve to create a regular overall shape of the shelf panel 2 by placing selected cells of varied geometries around the center region 105. In a preferred embodiment, the circumferential edge 106 is illustrated with a greater depth than the center region 105. What is contemplated is also the use of a center region 105 of greater depth than the circumferential edge 106.

Figure 8:
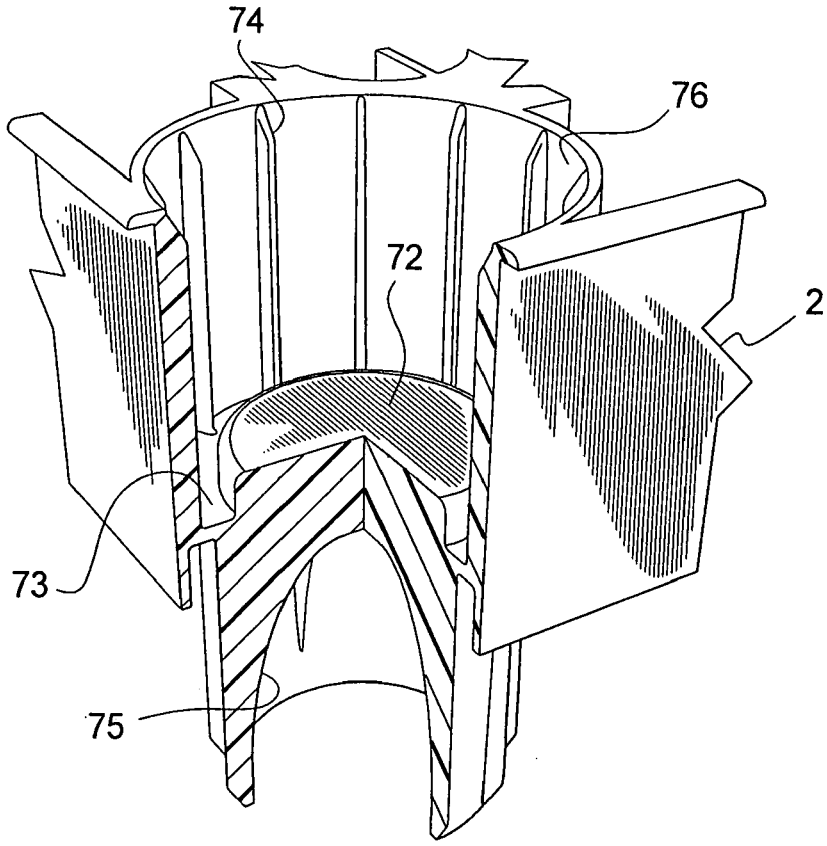
FIG. 8 is a quarter cut perspective view of a post support cell of the shelf panel of FIG. 2.

The second type of cell 9 may be functionally arranged to serve a plurality of secondary functions. In one preferred embodiment, at least one cell of the circumferential edge 106 serves as a post support 34. The post support 34 is shown as a cylindrical cell 33 comprising a middle wall 73 as shown in FIG. 8, a top cylinder 76, and a bottom cylinder 75. In one embodiment, the bottom cylinder 75 is of a third depth perpendicular to the plane 19. The bottom cylinder 75 as shown in FIG. 8 has a greater depth than the circumferential edge 106 that allows the bottom cylinder 75 to serve as a ground support 107 as shown on FIG. 1. In one embodiment, deformable centering ribs 74 are placed perpendicular to the top and bottom cylinders 75, 76 to guide the vertical posts 4 in the cylindrical cell 33 during insertion. A groove may be made in the middle wall 73 by rehaussing the middle wall 73 on both sides 72, 109. While a system where cylindrical posts 4 are slid over the bottom cylinder 75 or inside the top cylinder 76 is shown, what is contemplated is any method of fixation, whether fixed or temporary, where vertical posts 4 are used.

Figure 9:
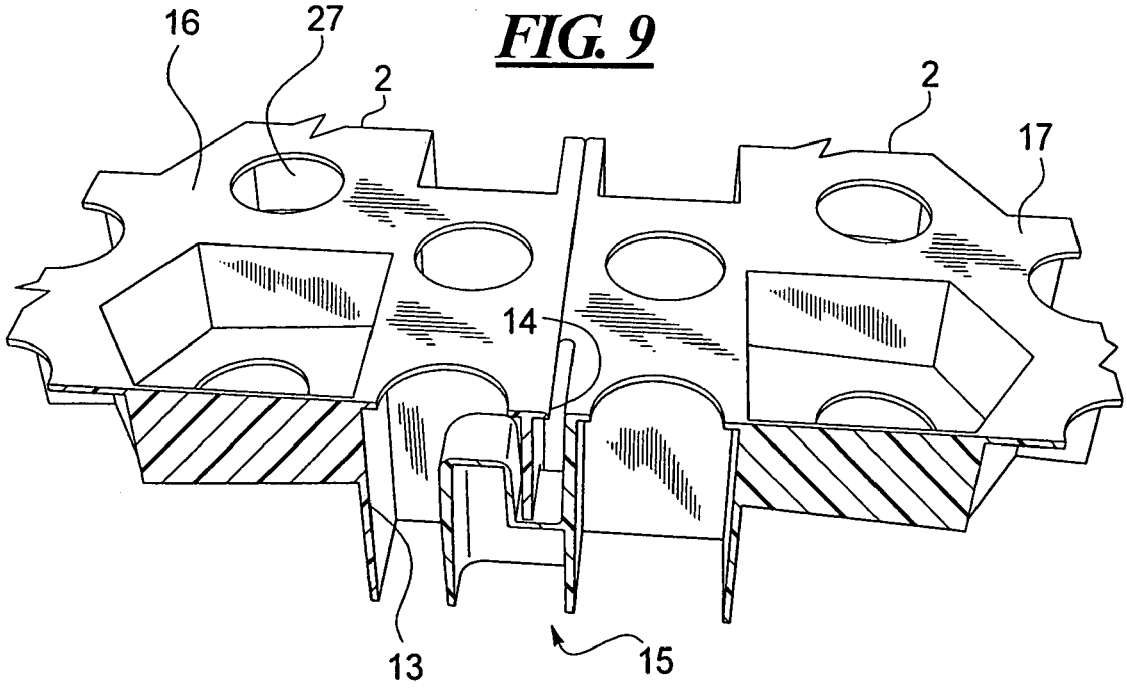
FIG. 9 is a selected segment cut view along the center of a set of male and female interlock between two interlocked shelf panels of FIG. 2.

In another embodiment, at least one cell on a first side 50 of a shelf panel 2 has a male interlock 13 as shown in FIGS. 4-5, and at least one cell on the second side 110 has a female interlock 14 as shown in FIGS. 2-3. The female interlock 14 is functionally compatible with the make interlock 13 as shown in detail on FIG. 9. In one preferred embodiment, the female interlock 14 is a rectangular shaped aperture 111 formed in one of the walls of a rectangular shaped cell 11 in the circumferential edge 106 of the shelf panel 2. The male interlock 13 is a upper finger hook of rectangular geometry. The placement of interlocks on the opposite sides of a single shelf panel 2 allows the use of a single type of shelf panel 2 when assembling two or more shelf panels 2 to form a shelf assembly 1. This assembly is conducted by displacing or rotating a shelf panel 2 on a plane 19 as shown in FIG. 15. What is also contemplated is an interlock system placed on a shelf panel 2 able to functionally join two or more shelf panels. Interlocks of different geometries or orientations are also contemplated, including but not limited to the use of a piece attached to a female interlock 14 to effectively transform the female interlock 14 into a male interlock 13. What is also contemplated is the use of a male upper finger hook 13 where the hook may be used to hold and hook other items. In another embodiment, a plurality of male interlocks 13 from a first shelf panel 2 on a first side are able to interlock with the second side of a second shelf panel 2 where a plurality of associated female interlocks are placed.

In yet another embodiment, the shelf panel 2 is part of a shelf assembly 1 comprising at least one shelf panel 2 located in a plane 19 along a longitudinal orientation 120 as shown on FIG. 1, and the shelf panel 2 comprises a first lateral section 131 located in a latitudinal orientation 130. The shelf assembly 1 also comprises at least one post 4, a shelf support wedge 21 as shown in FIG. 11 made of an interlock section 22 as shown in FIG. 12, and a fixation section 23 as shown in FIGS. 12-13. The shelf panel 2 further comprises a center region 105 shown in FIGS. 4-5 made of an array of a first type of cells 109 in said plane 19, and a circumferential edge 106 of a second type of cells 25 secured to said center region 105 in said plane 19, and wherein at least one cell 20 as shown in FIG. 13 on the first lateral section 131 is able to house the interlock section 22 of the shelf support wedge 21. In a preferred embodiment, the at least one cell 20 on a first lateral section 131 is of the same geometry as the interlock section 22, and in an even more preferred embodiment, said at least one cell 20 and the geometry of the interlock section 26 is semihexagonal in shape as shown in FIG. 10. The shelf support wedge 21 secures said shelf panel 2 to a wall 133 as shown in FIG. 13 by inserting the interlock section 22 in the at least one cell 20 and using a fixation means 24. It is understood by one of ordinary skill in the art that while one type of shelf support wedge 21 is shown, what is contemplated is any type of wedge or wall support designed to insert itself in the at least once cell 20 to affix the shelf panel 2 and the shelf assembly 1 to the wall 133. FIG. 13 shows in a preferred embodiment the use of two screws to affix the shelf panel 2 to the wall 133 using the shelf support wedge 21. What is also contemplated is the use of a plurality of shelf support wedges 21 based on the selected configuration of the shelving assembly 1.

In another embodiment, the shelf panel 2 is designed to be stored in an compact position upon a stack of other shelf panels 2. FIG. 14 illustrates the stacking of two shelf panels 2 according to one embodiment. The shelf panel comprises a center region 105 made of an array of a first type of cells 109 of a first depth parallel to a plane 19, a circumferential edge 106 made of at least a second type of cells 9 secured to the center region 105 in the plane 19 of a second depth forming a top 140 and a bottom 141 surface parallel to the plane 19, at least one post support cell 33 located on the circumferential edge 106 where the post support comprises a middle wall 73, a top cylinder 76, a bottom cylinder 75, and the bottom surface 143 as shown in FIG. 3 of the circumferential edge 106 of a first shelf panel 145 is placed on the top surface 142 of a second shelf panel 144 as shown on FIG. 14 and the bottom cylinder 34 of the first shelf 145 is inserted in the top cylinder 33 of the second shelf 144 to connect the bottom surface 143 of the first shelf panel 145 with the top surface 142 of the second shelf panel 144. FIG. 14 shows one possible embodiment where a second type of cells 95 is used to interlock the first shelf panel 145 with the second shelf panel 144. What is also contemplated is the use of grooves, guides, rails, clips, and even male interlocks 13 designed to help with the stacking of the shelf panels 2.

The above objects, features, and advantages of the present invention are readily apparent from the following detailed description of the best mode in which to practice the invention when taken in connection with the accompanying drawings wherein like numbers designate like parts throughout.

What is claimed is:

1. A shelf panel, comprising:

a plurality of first honeycomb cells arranged horizontally to form a main panel region, each first honeycomb cell comprising a first sidewall having the same horizontal shape and size and a first cell closing wall connected to the first sidewall, the plurality of first honeycomb cells comprising a plurality of first cells and a plurality of second cells, each first cell having a first wall structure comprising the first sidewall and the first cell closing wall connected to an upper end of the first sidewall, each second cell having a second wall structure comprising the first sidewall and the first closing wall connected to a lower end of the first sidewall; and a plurality of second honeycomb cells arranged around the main panel region, each second honeycomb cell comprising a second sidewall having a horizontal shape and size different from the horizontal shape and size of the first sidewalls and a second cell closing wall connected to one of an upper and a lower end of the second sidewall, wherein a number of the first cells is greater than a number of the second cells in the main panel region.

2. The shelf panel in accordance with claim 1, wherein the second cell is surrounded by a plurality of first cells to form the main panel region.

3. The shelf panel in accordance with claim 2, wherein the first sidewall has a hexagonal prism shape.

4. The shelf panel in accordance with claim 2, wherein the first sidewall has an octagonal prism shape.

5. The shelf panel in accordance with claim 2, wherein the first sidewalls and the first cell closing walls serve as an interlocked matrix of ribs of a uniform thickness.

6. The shelf panel in accordance with claim 5, wherein said uniform thickness is 1/16 of an inch.

7. The shelf panel in accordance with claim 2, wherein said first cell closing wall comprises a central passage edge.

8. The shelf panel in accordance with claim 7, wherein said central passage edge is circular.

9. The shelf panel in accordance with claim 1, wherein said shelf panel is made of molded plastic.

10. The shelf panel in accordance with claim 1, wherein the first sidewalls have various heights.

11. The shelf panel in accordance with claim 10, wherein heights of the first sidewalls gradually increase from a side to a middle of the main panel region.

12. A shelf panel comprising:

a circumference edge; and a main panel region surrounded by the circumference edge and comprising a plurality of first honeycomb cells arranged horizontally, each first honeycomb cell comprising a first sidewall having the same horizontal shape and size and a first cell closing wall connected to the first sidewall, the plurality of first honeycomb cells comprising a plurality of first cells and a plurality of second cells, each first cell having a first wall structure comprising the first sidewall and the first cell closing wall connected to an upper end of the first sidewall, each second cell having a second wall structure comprising the first sidewall and the first cell closing wall connected to a lower end of the first sidewall, wherein a number of the first cells is greater than a number of the second cells in the main panel region.

13. The shelf panel of claim 12, wherein the first sidewalls have a hexagonal prism shape.

14. The shelf panel of claim 12, wherein the first sidewalls have an octagonal prism shape.

15. The shelf panel of claim 12, wherein heights of the first sidewalls gradually increase from a side to a middle of the main panel region.

16. The shelf panel of claim 12, wherein each first cell closing wall comprises a central passage edge.

17. The shelf panel of claim 16, wherein the central passage edge is circular.

18. The shelf panel of claim 17, wherein the uniform thickness is 1/16 of an inch.

19. The shelf panel of claim 12, wherein the first sidewalls and the first cell closing walls have a uniform thickness.

20. The shelf panel of claim 12, wherein the plurality of first cells are substantially the same shape and size and the plurality of second cells are substantially the same shape and size.

21. A shelf panel, comprising:

a circumference edge; and a main panel region surrounded by the circumference edge and comprising a plurality of first honeycomb cells arranged horizontally, each first honeycomb cell comprising a first sidewall having the same horizontal shape and size and a first cell closing wall connected to the first sidewall, the plurality of first honeycomb cells comprising a plurality of first cells and a plurality of second cells, each first cell having a first wall structure comprising the first sidewall and the first cell closing wall connected to an upper end of the first sidewall, each second cell having a second wall structure comprising the first sidewall and the first cell closing wall connected to a lower end of the first sidewall, wherein a number of the first cells is greater than a number of the second cells in the main panel region, and wherein the circumference edge comprises a plurality of second honeycomb cells, each second honeycomb cell comprising a second sidewall and a second cell closing wall connected to the second sidewall, the second sidewall having horizontal shape and size different from the horizontal shape and size of the first sidewall.

22. The shelf panel of claim 21, wherein the plurality of second sidewalls have a height greater than that of the plurality of first sidewalls.

23. The shelf panel of claim 21, wherein the circumference edge further comprises a third wall structure for supporting a post.

24. The shelf panel of claim 23, wherein the third wall structure has a cylindrical shape.

25. The shelf panel of claim 21, wherein the circumference edge further comprises a male interlock and a female interlock.

* * * * *